United States Patent [19]

Miller

[11] 4,311,498

[45] Jan. 19, 1982

[54] DESUPERHEATER CONTROL SYSTEM IN A REFRIGERATION APPARATUS

[75] Inventor: Donald K. Miller, York, Pa.

[73] Assignee: Borg-Warner Corporation, Chicago, Ill.

[21] Appl. No.: 168,921

[22] Filed: Jul. 14, 1980

[51] Int. Cl.[3] ..... F25D 17/00; F25B 27/02

[52] U.S. Cl. ..... 62/181; 62/184; 62/196 C; 62/238.6

[58] Field of Search ..... 62/196 C, 184, 238.6, 62/DIG. 17, 181, 196 B

[56] References Cited

U.S. PATENT DOCUMENTS

| | | | |
|---|---|---|---|
| 2,142,734 | 1/1939 | Polley | 62/184 |
| 2,703,965 | 3/1955 | Shawhan | 62/181 |
| 3,188,829 | 6/1965 | Siewert et al. | 62/160 |
| 3,301,002 | 1/1967 | McGrath | 62/175 |
| 4,089,667 | 5/1978 | Jonsson | 62/238 |
| 4,123,914 | 11/1978 | Perez et al. | 62/196 B |
| 4,142,379 | 3/1979 | Kuklinski | 62/179 |
| 4,146,089 | 3/1979 | Mueller et al. | 165/145 |
| 4,193,781 | 3/1980 | Vogel et al. | 62/196 C |

*Primary Examiner*—William E. Wayner
*Assistant Examiner*—Harry Tanner
*Attorney, Agent, or Firm*—Thomas B. Hunter

[57] ABSTRACT

A desuperheater control system for use in a refrigeration apparatus includes a thermostatic expansion valve which responds to the temperature and pressure at the outlet of a desuperheater for bypassing refrigerant flow from the condenser back to the suction side of the compressor. A pressure chamber is connected to the outlet of the expansion valve to sense the pressure therein. A water regulating valve is responsive to the pressure in the pressure chamber for regulating the water flow through the desuperheater so that the superheated refrigerant gas from the compressor is cooled to a preselected temperature having a minimum superheat.

5 Claims, 1 Drawing Figure

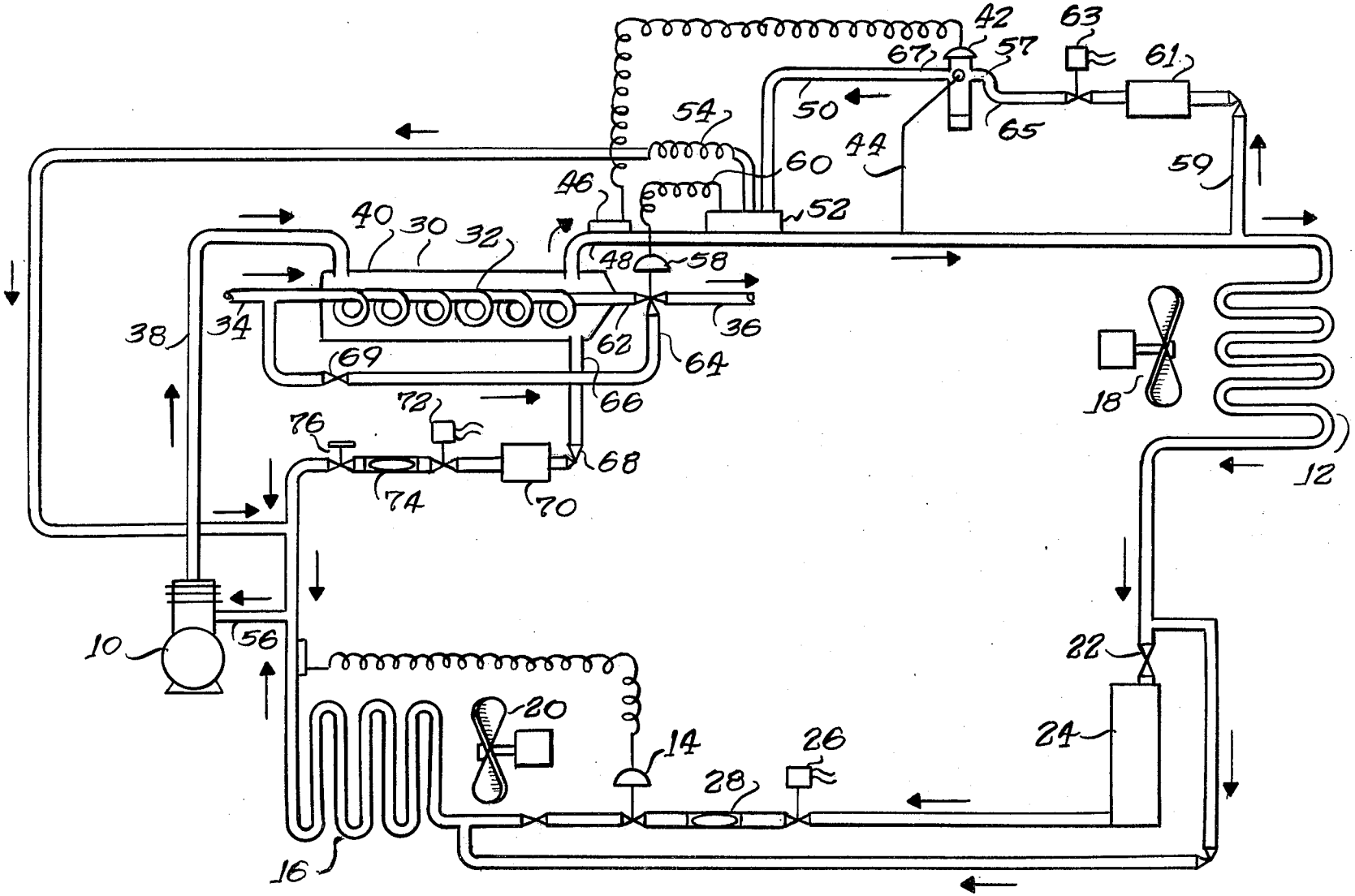
12
18
22
24
26
28
14
20
16
10
56
38
34
30
32
40
69
76
74
78
70
68
66
62
64
36
58
48
46
54
52
60
50
44
67
42
57
65
63
61
59

DESUPERHEATER CONTROL SYSTEM IN A REFRIGERATION APPARATUS

BACKGROUND OF THE INVENTION

1. Field of the Invention:

This invention relates generally to a refrigeration apparatus and more particularly, it relates to a desuperheater control system for use in a refrigeration apparatus which regulates the superheat condition at all times to obtain partial heat recovery.

2. Description of the Prior Art:

In U.S. Pat. No. 3,301,002 issued to W. L. McGrath on Jan. 31, 1967, there is described an apparatus for heating water which includes a second compressor and condenser incorporated into a primary refrigeration system utilizing one of the heat exchange coils thereof as an evaporator.

In U.S. Pat. No. 3,188,829 issued to H. G. Siewert et al. on June 15, 1965, there is described a refrigeration system adapted for heating water which includes a heat exchanger disposed between the compressor and the condenser for bringing secondary medium to be conditioned into heat exchange relationship with the refrigerant and a pressure responsive valve operable to maintain a predetermined minimum refrigerant condensing pressure entering the evaporator.

In U.S. Pat. No. 4,123,914 issued to A. Perez et al. on Nov. 7, 1978, there is described a refrigeration system having a heat recovery section and a two-positioned valve responsive to external conditions to direct the flow of compressor discharge gases to the condenser or to the heat recovery section.

In U.S. Pat. No. 4,142,379 issued to H. W. Kuklinski on Mar. 6, 1979, there is shown an energy conservation device disposed between the compressor of an air conditioning unit and a conventional hot water heater for controlled water heating with rejected compressor heat.

In U.S. Pat. No. 4,146,089 issued to Mueller et al. on Mar. 27, 1979, there is shown a hot water system having a specially designed condenser from which large quantities of hot water is produced.

In U.S. Pat. No. 4,089,667 issued to K. A. Jonsson on May 16, 1978, there is disclosed a heat extraction system for air conditioning and refrigeration systems which includes a modified coaxial, counter-flow supplemental heat exchanger for heating water, the heat exchanger being disposed between a conventional compressor and condenser.

It is generally known that in air conditioning and refrigeration systems very large amounts of heat energy is normally dissipated into the surrounding air at the location of the condenser. In this age of energy conservation, it has become necessary to utilize the rejected heat from the air conditioning and refrigeration systems for some useful heating purpose, i.e., to heat water in a storage tank, and in the process, eliminate or reduce the consumption of other expensive fuel sources such as gas, electricity or oil. There are many prior art systems which act to conserve energy by absorbing the exhaust heat energy from the refrigerant for hot water heating using a supplemental heat exchanger at a location upstream of the conventional condenser. However, no provision has been made heretofore to control desuperheating selectively at all times to obtain partial heat recovery through a water regulating valve so as to insure maximum efficiency of the system.

The instant invention overcomes deficiencies in the prior art by providing a desuperheater control system which desuperheats the hot refrigerant gas from the compressor at all load conditions to within approximately 10° F. of the saturated discharge pressure so as to avoid condensation. The employment of the present invention improves the coefficient of efficiency of the refrigeration apparatus by removing optimally the amount of superheat from the compressor gases and results in energy cost-savings due to the heating of water with rejected refrigeration heat at a minimal investment.

SUMMARY OF THE INVENTION

Accordingly, it is a general object of the present invention to provide a desuperheater control system for use in a refrigeration apparatus which regulates the superheat condition at all times to obtain partial heat recovery.

It is another object of the present invention to provide water regulating means to control desuperheating selectively at all times to obtain partial heat recovery so as to insure maximum efficiency of the refrigeration apparatus.

It is another object of the present invention to provide a desuperheater control system for installation upstream of the conventional condenser for removing optimally the amount of superheat from the compressor gas without producing condensation and for heating water at a minimal investment.

It is still another object of the present invention to provide a desuperheater control system which is readily adapted for use as a integral part of a new refrigeration apparatus or as a field-modified add-on component to a present system without affecting adversely the performance thereof.

It is yet still another object of the present invention to provide a desuperheater control system which is relatively simple to manufacture and easy to assemble and install.

In accordance with these aims and objectives, there is provided in the present invention a desuperheater control system for use in a refrigeration apparatus which includes a compressor, a condenser, an expansion device, and an evaporator, all suitably interconnected to form a closed refrigerant circuit. A desuperheater is provided with a conduit having an inlet and an outlet through which the water to be heated is circulated and a housing having an inlet and an outlet through which the superheated refrigerant gas from the compressor is passed. A high temperature pilot valve has its external equalizer connection joined to the outlet of the desuperheater to sense the pressure thereof and has a temperature bulb disposed adjacent the outlet of the desuperheater to sense the temperature thereof. The pilot valve is utilized to bypass refrigerant flow from the desuperheater back to the suction side of the compressor. A pressure chamber is operatively connected to the outlet of the pilot valve to sense the pressure therein. A water regulating valve responsive to the pressure in the pressure chamber is provided for regulating the water flow through the desuperheater so that the superheated refrigerant gas from the compressor is cooled to a preselected temperature having a minimum superheat.

DESCRIPTION OF THE DRAWING

These and other objects and advantages of the present invention will become more fully apparent from the detailed description when read in conjunction with the accompanying drawing in which there is shown a schematic diagram of a desuperheater control system for use in a refrigeration apparatus embodying the principles of the present invention.

DESCRIPTION OF THE PREFERRED EMBODIMENT

Referring now to the drawing, there is shown a refrigeration apparatus including a compressor 10, an air-cooled condenser 12, a thermostatic expansion valve 14 and an evaporator 16, all suitably interconnected to form a refrigerant circuit. The condenser 12 is normally located outdoors, and an outdoor fan 18 brings ambient air to flow across the condenser in heat exchange relationship. The evaporator 16 is normally located indoors, and an indoor fan 20 causes the air to be conditioned to pass into heat exchange relationship with the evaporator. The refrigeration apparatus preferably includes a valve 22, a filter dryer 24, a solenoid valve 26, and a sight glass 28 connected in series between the condenser 12 and the expansion valve 14.

In order to regulate the superheat condition of the gas from the compressor 10 at all times so as to obtain partial heat recovery, a desuperheater control system according to the present invention is provided between the outlet of the compressor 10 and the inlet of the air-cooled condenser 12. The desuperheater control system comprises heat recovery means defining a desuperheater or heat exchanger 30 having a conduit 32 which receives relatively cold water via line 34 from a not-shown storage tank. The water is returned to the storage tank through line 36 after heating. The hot refrigerant discharge gas from the compressor 10 is delivered to line 38 and housing 40 which is disposed within the heat exchanger 30 for heat exchange relationship with the water to be heated passing therein.

The desuperheater control system is provided with a high temperature thermostatic expansion valve 42 which functions as a pilot valve. The thermostatic expansion valve 42 senses the discharge gas pressure leaving the desuperheater 30 through external equalizer connection 44 and compares the same with the pressure sensed from a temperature bulb 46 positioned adjacent the line 48 at the desuperheater outlet. This differential pressure is applied via conduit 50 for pressurizing a small pressure chamber 52 which has a capillary bleed line 54 fed back to the suction line 56 of the compressor 10 so that the level of pressure can be constantly maintained at the desired level in response to the desired superheat condition. The valve 42 receives desuperheated refrigerant at its inlet 57 via conduit 59, a filter dryer 61, a solenoid valve 63, and line 65. The desuperheated refrigerant at the outlet 67 of the valve is passed through the conduit 50 and the capillary tube 54 to the suction line 56 of the compressor.

The desuperheater control system is also provided with a three-way water regulating valve 58 responsive to the pressure of the pressure chamber 52 via capillary 60. The water regulating valve 58 controls the cooling rate for the desuperheater 30 and assures maximum desuperheating without condensation. A first inlet of the valve 58 is connected to the outlet of the desuperheater on line 62, and a second inlet of the valve 58 is coupled to bypass line 64 which includes a cock valve 69. The outlet of the valve 58 is joined to the water return line 36.

In the process of desuperheating, any oil entrained in the stream of refrigerant flowing through the housing 40 accumulates in the lower portion of the desuperheater 30 from where it may be passed through line 66, isolation valve 68, a filter dryer 70, a solenoid valve 72, a sight glass 74, and a small hand-operated expansion valve 76 to the suction line 56 of the compressor 10. This ensures that an adequate supply of oil for the compressor is provided so as to avoid a failure thereof. The expansion valve 76 is set to pass only oil or minimal liquid accumulation in the desuperheater which can be observed in the sight glass 74.

In normal operation of the refrigeration apparatus, the solenoid valves 26, 63 and 72 are all energized so as to be in the opened position. The compressor 10 compresses the low pressure cool refrigerant gas from the suction line 56 and discharges high pressure, high temperature refrigerant gas, the so-called superheated gas, which is circulated in the line 38 to one side of the desuperheater 30. The water to be heated is delivered by way of the line 34 from the storage tank to the other side of the desuperheater. Here the hot gas is cooled to a temperature having a pre-selected minimal superheat so as to provide optimal desuperheating of the compressor discharge gas and yet avoid any condensing thereof. The desuperheater control system of the present invention is utilized to accomplish this feature which will be explained more fully hereinafter. The refrigerant cooled to the pre-selected minimum superheat is then passed on the line 48 to the conventional air-cooled condenser 12. Heat extracted from the refrigerant by the air stream passing over the condenser under the influence of the fan 18 causes condensation of the refrigerant to a saturated liquid. The liquid refrigerant from the condenser 12 is then passed to the expansion valve 14 which regulates the flow of refrigerant through the evaporator 16. In the evaporator, the refrigerant is vaporized by the stream of air passing thereover under the influence of the indoor fan 20 and is delivered to the suction line 56 of the compressor 10.

In order to precisely regulate the superheated gas at the discharge line 48 of the desuperheater 30, the thermostatic expansion valve 42 is preset for approximately 10° F. minimum superheat. The adjustable pressure setting of the water regulating valve 58 is initially determined at saturated pressure level for the refrigerant which corresponds to about 91.5° F. or 172 psig operating head pressure for R-22 refrigerant. This represents the normal minimum condensing temperature during low ambient condition and when the compressor is operating at minimum capacity. The expansion valve 42 is preferably of the general type sold and manufactured by Sporlan under their designation GVE-1, type L. As the superheat exceeds 10° F., the expansion valve 42 opens for pressurizing the chamber 52. As a result, the water regulating valve 58 closes the bypass line 64 to allow more water flow through the desuperheater, thereby making use of the increased temperature of the superheated refrigerant discharge gas for absorbing the heat to heat the water. The water regulating valve 58 is preferably of the general type sold and manufactured by Penn Division of Johnson Controls, Inc. designated with Series V48. On the other hand, as the superheat falls below 10° F. the expansion valve 42 closes which causes in turn the water regulating valve 58 to open for bypassing water from the desuperheater 30, thus maintaining a minimum 10° F. superheat level.

In order to prevent refrigerant migration and malfuction of the refrigeration apparatus due to ambient cooling effects, the body of the expansion valve 42, the pressure chamber chamber 52 and the body of the water regulating valve 58 are all strapped physically to the outside of discharge line 48 of the desuperheater which is experiencing a superheat condition. Further, the valves 42, 58 and the pressure chamber 52 are insulated to preclude loss of heat which is needed to vaporize possible migrated refrigerant. A pressure gauge and a thermometer, which are not shown, can be provided in the discharge line 48 for setting the superheat adjustment of the valve 42.

From the foregoing detailed description it can thus be seen that the present invention provides a desuperheater control system for use in a refrigeration apparatus which regulates the superheat condition at all times to obtain partial heat recovery. Further, the control system includes a thermostatic expansion valve for bypassing refrigerant flow from the desuperheater to the suction side of the compressor. A water regulating valve responsive to the pressure in the pressure chamber is provided for regulating the water flow through the desuperheater so that the superheated refrigerant gas from the compressor is cooled to a preselected temperature having a minimum superheat.

While there has been illustrated and described what is at present to be a preferred embodiment of the present invention, it will be understood by those skilled in the art that various changes and modifications may be made and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention but that the invention will include all embodiments falling within the scope of the appended claims.

What is claimed is:

1. A desuperheater control system for use in a refrigeration apparatus including a compressor, a condenser, an expansion device, and an evaporator, all suitably interconnected to form a closed refrigerant circuit, said system comprising:

heat recovery means coupled between the discharge side of the compressor and the inlet of the condenser;

pilot valve means responsive to temperature and pressure at the outlet of said heat recovery means for bypassing refrigerant flow from said condenser back to the suction side of said compressor;

a pressure chamber connected to the outlet of said pilot valve means to sense pressure therein; and water regulating valve means responsive to the pressure in said pressure chamber for regulating the water flow through said heat recovery means so that the superheated refrigerant from the compressor is cooled to a pre-selected temperature having a minimum superheat.

2. A control system as claimed in claim 1, wherein said heat recovery means comprises a desuperheater having a conduit with an inlet and an outlet through which water to be heated is circulated and a housing having an inlet and an outlet through which the superheated refrigerant gas from the compressor is passed.

3. A control system as claimed in claim 2, wherein said pilot valve means comprises a high temperature thermostatic expansion valve having its external equalizer connection joined to the outlet of the desuperheater to sense the pressure thereof and a temperature bulb disposed adjacent the outlet of the desuperheater to sense the temperature thereof.

4. A control system as claimed in claim 3, wherein said water regulating valve means comprises a three-way valve.

5. A control system as claimed in claim 1, further comprising means connected to said heat recovery means for removing any oil entrained in the stream of refrigerant flowing through said heat recovery means.

* * * * *